United States Patent [19]

Thaler et al.

[11] Patent Number: 4,542,284

[45] Date of Patent: Sep. 17, 1985

[54] ELECTRICAL APPLIANCE WITH DELAYED WARNING ALARM

[75] Inventors: Arnold Thaler, Plantation, Fla.; Lai Kin, Kowloon, Hong Kong

[73] Assignee: Windmere Corporation, Hialeah, Fla.

[21] Appl. No.: 456,498

[22] Filed: Jan. 7, 1983

[51] Int. Cl.[4] ..... H05B 1/02

[52] U.S. Cl. ..... 219/506; 219/492; 219/507; 219/509; 340/655

[58] Field of Search ..... 219/506, 501, 493, 492, 219/494, 497, 508–510, 507; 340/654, 655, 529, 540, 527, 530

[56] References Cited

U.S. PATENT DOCUMENTS

| | | | |
|---|---|---|---|
| 1,759,805 | 5/1930 | Pollock et al. | 340/687 |
| 1,935,771 | 11/1930 | Feurstein et al. | 340/656 |
| 2,532,647 | 12/1950 | Sillers | 340/644 |
| 2,970,228 | 1/1961 | White et al. | 307/605 |
| 3,505,664 | 4/1970 | Morris | 340/644 |
| 3,815,110 | 6/1974 | Davidson | 340/654 |
| 3,846,777 | 11/1974 | Brown | 340/654 |
| 3,866,204 | 2/1975 | Barkley | 340/530 |
| 3,878,540 | 4/1975 | Kawai | 340/530 |
| 3,945,728 | 3/1976 | Crandell | 355/75 |
| 3,962,696 | 6/1976 | Smith et al. | 340/530 |
| 4,016,428 | 4/1977 | Gutterman | 307/116 |
| 4,028,691 | 6/1977 | Zeder | 340/568 |
| 4,044,348 | 8/1977 | Huebscher | 99/342 |
| 4,080,598 | 3/1978 | Cardone | 340/683 |
| 4,203,101 | 5/1980 | Towsend | 340/635 |
| 4,218,717 | 8/1980 | Shuster | 361/79 |
| 4,339,649 | 7/1982 | Hronchek | 219/506 |

*Primary Examiner*—M. H. Paschall

*Attorney, Agent, or Firm*—Fleit, Jacobson, Cohn & Price

[57] ABSTRACT

In combination with an electrical appliance, an automatic warning circuit to warn a user of an electrical hazard wherein the warning circuit comprises a timing circuit responsive to turn-off of the electrical appliance for generating a triggering signal after lapse of a predetermined time period after turn-off thereby to energize an audible alarm. The timing circuit and alarm are useful for warning a user of the appliance of an electrical safety hazard brought out by the appliance being connected to a power line while not being used.

12 Claims, 2 Drawing Figures

ELECTRICAL APPLIANCE WITH DELAYED WARNING ALARM

BACKGROUND OF THE INVENTION

1. Field of the Invention

This invention pertains to a safety device for reducing the likelihood of accidental electrocution caused by an electrical appliance that is typically used in the vicinity of water, and, more particularly, to a safety device for an electrical appliance, such as a hair dryer or shaver, having a delayed-action alarm system that activates within a predetermined time period when an idle appliance that has been turned off is coupled to a power source.

2. Background of the Prior Art

Many hand-held home appliances, such as hair dryers, electric shavers, or similar electrical appliances, present an undue risk of injury when used near water and connected to an electrical outlet. This is particularly true even when the appliance is turned off. Should an appliance that is turned off, but plugged into a household power supply, accidentially fall into a bathtub or a wash basin while a person has a portion of his body in contact with the water in the tub or basin, the person could be electrocuted or otherwise injured. Electrocution results from the conductors of the power cord or the on-off switch coming into contact with the water.

Most home appliances operate on alternating current and include a power cord adapted to plug into an alternating current wall outlet. The conductors of the power cord connect to an on-off contact switch in the appliance. The switch is manually operated for making and breaking electrical connection with a motor, a heater element, or an electrical circuit in the appliance. Within the switch, the electrical connections are accomplished through conductive contacts which, if placed in water, present the hazardous condition just described. Some switches used in home appliances are double-poled, single-throw and operate to break both lines of an a.c. power source, whereas other switches are single-pole, single-throw and break only one of the a.c. lines. In the latter type of switch, if the "hot" line is not broken, the appliance, if submerged in water, may still provide a complete circuit path to ground, such as through the plumbing pipes of the tub or basin. Thus, for increased safety, it is desirable to disconnect the appliance from the power supply.

Some manufacturers of appliances place warning labels on their product instructing the user to disconnect the appliance when not in use, but such warnings often go unheeded. Attempts might be made to reduce the likelihood of accidental electrocutions by insulating and/or waterproofing electrical circuits of the appliance, however, such waterproofing or insulating may not be justified in view of the costs involved in doing so. Sometimes, after prolonged use, the insulation or waterproofing becomes ineffective.

One solution to this problem is provided by the use of a ground fault interrupter placed in the household electrical line. If an appliance falls into a filled basin or tub, then the ground fault interrupter, through a fast-acting circuit breaker, senses the ground fault current and disrupts power to the appliance. Even though the ground fault interrupter has met with great success, many older homes and buildings do not contain such a device. Further, there are situations where the appliance may be used near water and plugged into a socket that is not protected by a ground fault interrupter.

In other situations, the on-off switch of the appliance is located in the power cord, in which case, if the appliance falls into the water, current will not flow therethrough. But in some instances, the electrical outlet itself may be located in close proximity of the water basin. In this case, the switch contacts themselves can still fall into the basin or tub and come into contact with the water. It would appear, then, to obviate accidental electrocutions, or at least to reduce their likelihood, the on-off switch might be placed directly at the wall plug of the power cord next to the electrical receptacle. But such a design would impose an inconvenience on the user with some types of electrical appliances where frequent on-off use is desired, such as a shaver, hair dryer or electric toothbrush.

It is therefore an objective of this invention to reduce the likelihood of such accidental electrocutions which might occur with electrical appliances generally used around water.

It is another objective of the present invention to provide a warning system for such hand-held electrical appliances, which warning system permits convenient, frequent on-off use often desired with such appliances.

SUMMARY OF THE INVENTION

To that end, one aspect of the invention comprises an electrical appliance including a timing circuit and alarm device coupled thereto, being operable such that, when the appliance is turned off for a predetermined time period while connected to an electrical power source, the alarm is activated. More specifically, the timing circuit and alarm unit are electrically connected to the on-off switching contacts of the electrical appliance to receive line power when the switch is placed in the "off" position. When the on-off switch is placed in the "off" position, preferably a capacitor in the timing circuit begins to accumulate charge. When the capacitor reaches a predetermined voltage level, it triggers a logic network to drive the alarm, which preferably is a piezoelectric buzzer. If the appliance is disconnected from the power source, the capacitor does not accumulate charge, and the alarm will not sound. Also, when the appliance is switched back to the "on" position, the capacitor discharges or is held below the triggering voltage level of the logic network.

Other aspects, features, and advantages of the invention will become apparent upon review of the succeeding disclosure taken in connection with the accompanying drawings. The invention though is pointed out with particularity in the appended claims.

DESCRIPTION OF ILLUSTRATIVE EMBODIMENT

Figure 1:
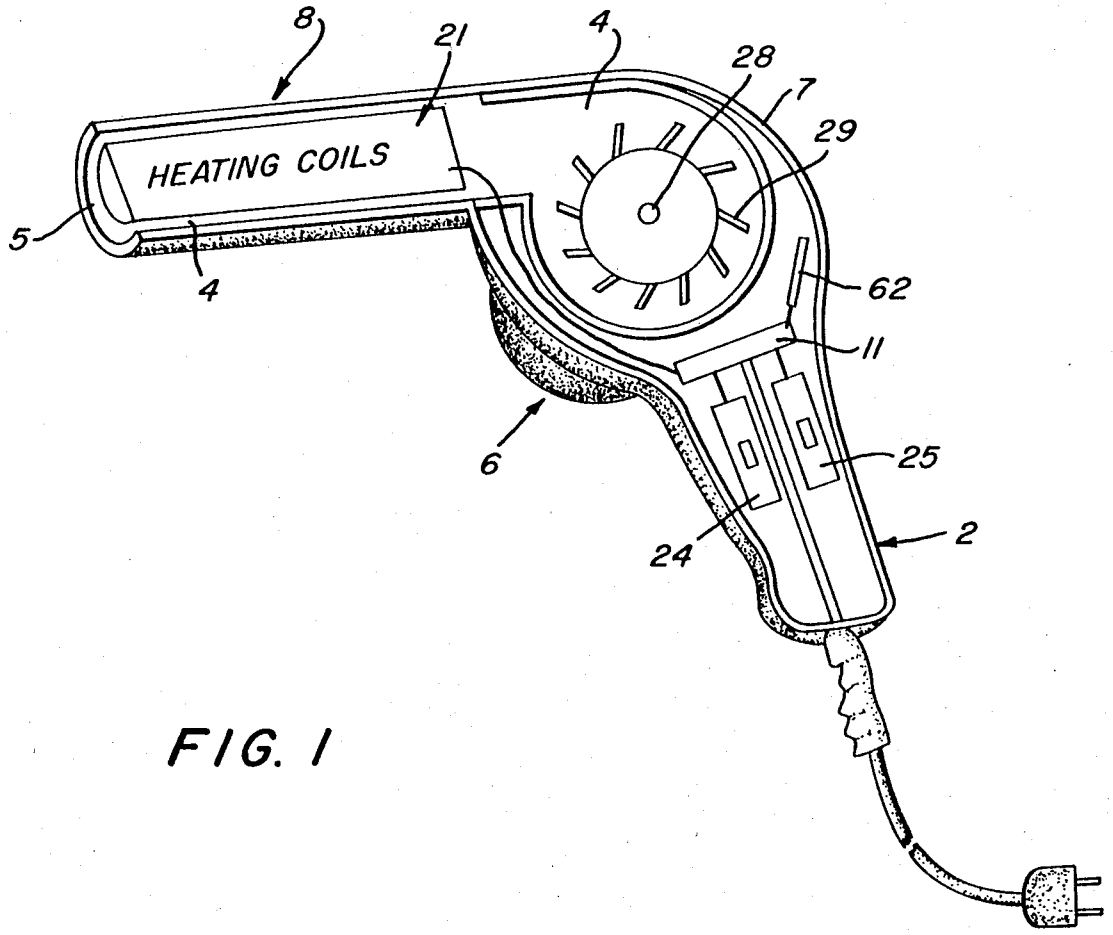
FIG. 1 is a schematic illustration of a conventional hair dryer embodying the subject invention.

When describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to FIG. 1, the present invention is shown in connection with the utilization circuit of a hair dryer 6. FIG. 1 shows a conventional hair dryer 6 with a portion removed to reveal the interior of the hair dryer incorporating the subject invention.

Basically, the hair dryer comprises a handle portion 2 which contains a pair of double-pole, triple-throw switches 24 and 25. Switch 24 is used to activate various of the heating coils, which are generally designated as 21, in order to alter the temperature within the airflow chamber 4 defined in the housing. Switch 25, on the other hand, is used to alter the speed of a motor 28 which, in turn, is used to drive a fan 29 in order to produce airflow within the airflow chamber and out the front end 5 of the barrel 8 of the hair dryer. Placed within a vacant portion of the interior of the hair dryer, near the point where the handle 2 meets the body 7, is a printed circuit board 11, which contains certain logic circuitry. The logic circuitry is used to drive an alarm 62 which is also positioned within a vacant portion of the housing.

The hair dryer is the type of electrical appliance where frequent on-off use is desired. Therefore, the on-off switch 25 is most desirably placed in the hand-held blower-dryer operating unit. Other types of appliances may have their switch contacts placed in the power cord, away from utilization circuits, and even in the wall plug of the power cord.

Figure 2:
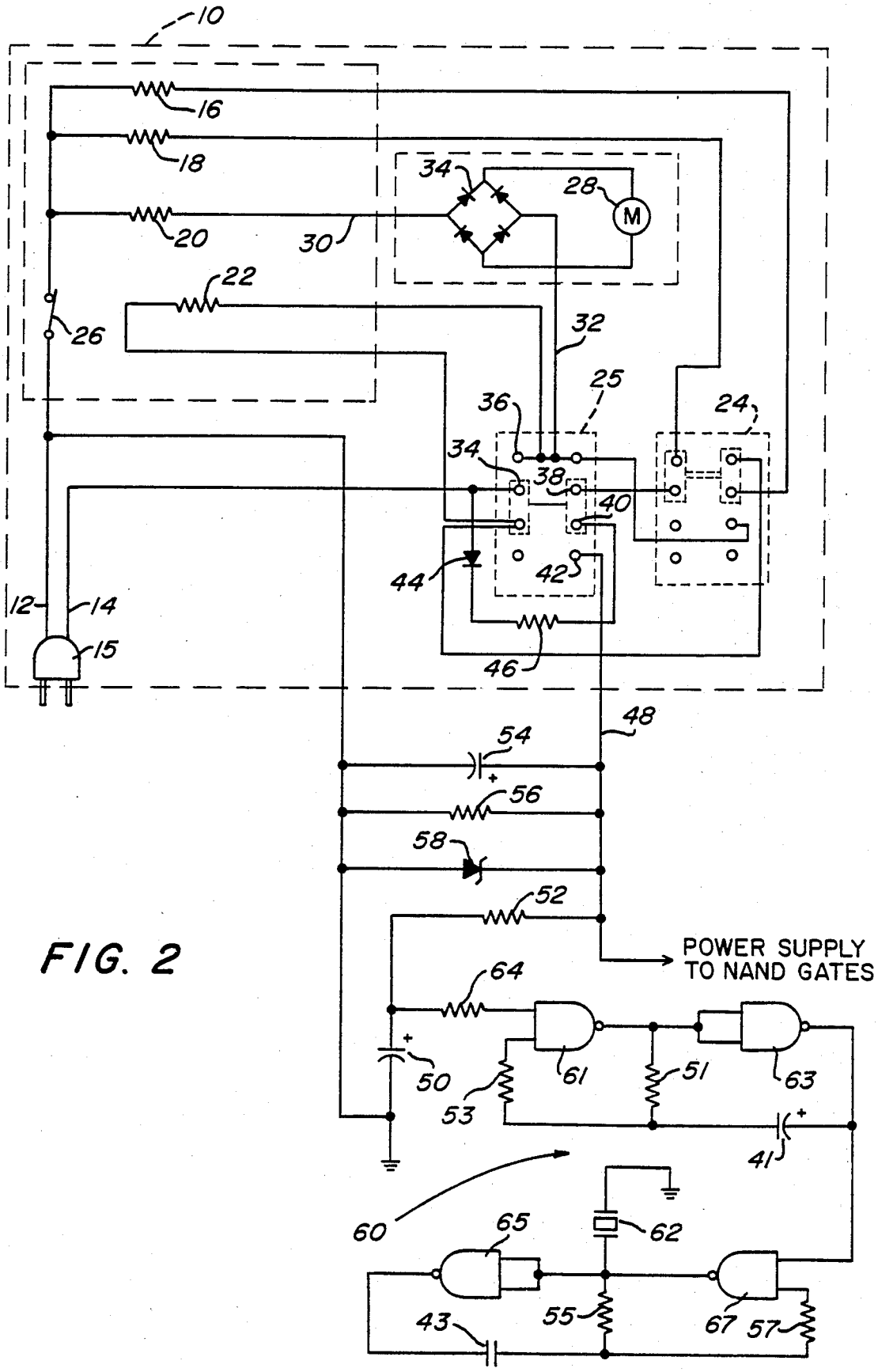
FIG. 2 depicts the electrical circuits of both the hair dryer of FIG. 1 and the on-off switching network, together with the timing circuit and alarm system of the subject invention.

As shown in FIG. 2, the hair dryer circuit is electrically connected to a plug 15 through conductors 12 and 14. The plug is adapted for use with a conventional household power outlet which delivers a 125-volt alternating current (a.c.). The conductors 12 and 14 excite heating coils 21, depicted as resistive elements 16, 18, 20 and 22, with alternating current. The heating coils 16–22 are located in the airflow chamber 4 of the hair dryer 6. A switching network 24 determines which of the heating elements 16–22 will be excited when operating the hair dryer, e.g., to select the heating coils to be activated. In the preferred embodiment, the network 24 is a double-pole, triple-throw switch. As a safety feature, a thermally actuated switch 26 disposed in series with line 12 opens the a.c. power line to all heating elements when the temperature in the airflow chamber of the hair dryer reaches a predetermined unsafe level. A second switching network 25 turns the hair dryer on and off by routing power to switching network 24 and to the motor 28. Switching network 25 also alters the power to the motor thus altering the speed of the fan 29 and the flow of air through the flow chamber over the heating elements 16–22 when excited by line power received over conductors 30 and 32 via a rectifier circuit 34.

In the particular embodiment shown, motor current is limited by the resistance of one of the heating elements 20. Thus, it is seen that, when the on-off switch 25 short circuits terminal 34 with terminal 36 or 38, the hair dryer is operative to heat the selected heating element and to drive the motor 28.

When the hair dryer is switched off, terminal 40 connects with terminal 42 to supply a current limited rectified current through a diode 44 and resistor 46. A conductor 48, coupled to the terminal 42, in turn, supplies the rectified line power to both a timing circuit constituted by a capacitor 50 and a very large resistor 52 and an alarm circuit 60. Preferably, resistor 52 has a resistive value of about 830 K ohms and electrolytic capacitor 50 has a capacitive value of about 100 microfarads and a 10-volt rating.

A filtering circuit comprising capacitor 54 and resistor 56 connects in parallel across the a.c. power line to supply a substantially constant direct current power to the charging capacitor 50. In a preferred embodiment, capacitor 54 has a capacitive value of about 100 microfarads and is rated at 10 volts while the resistor 56 has a resistive value of about 5,600 ohms. Further, a zener diode 58 provides voltage protection for the charging capacitor 50, the filtering circuit and the alarm circuit 60, the latter being described next.

The alarm circuit, generally designated as 60, essentially comprises a logic network arranged to activate an alarm in the form of a piezoelectric transducer 62. In the preferred embodiment, the logic network comprises a quad two-input NAND gate, such as that manufactured by National Semiconductor, and bearing Product Designation CD4011M.

With specific reference to FIG. 2, the logic network is arranged as follows. Four dual input NAND gates 61, 63, 65 and 67 are provided. The positive terminal of the electrolytic capacitor 50 is connected to one of the inputs of NAND gate 61 via resistor 54. The output of NAND gate 61 is coupled to both of the inputs of NAND gate 63. The output of NAND gate 63 in turn is connected to the positive terminal of electrolytic capacitor 41. The negative terminal of this resistor is then connected to the remaining input of NAND gate 61 via resistor 53 and to the output of NAND gate 61 via resistor 51.

The output of NAND gate 63 is also connected to one of the inputs of NAND gate 67. The output of NAND gate 67 is coupled to both of the inputs of NAND gate 65. The output of NAND gate 65 is connected to capacitor 43. The other end of capacitor 43 is connected to the remaining input of NAND gate 67 via resistor 57 and to the output of NAND gate 67 via resistor 55. The output of NAND gate 67 is also connected to one terminal of the piezoelectric transducer 62. The other terminal of the transducer is connected to ground. At the same time, the negative side of capacitor 50 is also connected to ground. Finally, line 48 provides operating power to each of the NAND gates.

When the hair dryer is operative and switch 25 is in either of two "on" positions, no power is provided to the NAND gates because line 48 is in an open circuit condition. As soon as the hair dryer is turned off by placing the switch 25 so that contacts 40 and 42 are brought into a conductive relationship, the NAND gates are made operative by the power on line 48. At the same time, a voltage accumulates on the charging capacitor 50. After a predetermined time period, as established by the value of resistor 52 and capacitor 50, which in the preferred embodiment is approximately $1\frac{1}{2}$ minutes, NAND gate 61 is triggered by a triggering signal constituted by the voltage accumulated on capacitor 50 with two logic 1's appearing at the inputs to NAND gate 61, the output of the NAND gate becomes a logic 0, triggering NAND gate 63 to a new steady state signal, that charges capacitor 41 and also is placed into NAND gate 67, which together with NAND gate 65 act as an oscillator to drive the piezoelectric buzzer 62 to give the audible signal. It is also contemplated that in certain situations it is desirable to remove the oscillator created by NAND gates 65 and 67 when the piezoelectric alarm 62 is replaced by a noise device such as a speaker which can operate under a steady signal.

The predetermined time period may be any fixed time period and may be dictated by the nature of the appliance, say between a few seconds to a few minutes. If the hair dryer is turned on again, the connection between terminals 40 and 42 is broken and the accumulated charge on capacitor 50 begins to drain through resistors 54, 52 and 56. The voltage accumulated on capacitor 50 falls below the triggering level required for NAND gate 61. Thus, the audio alarm 62 will cease when the appliance is turned on again after activation of the alarm is inhibited. Also, if the hair dryer is disconnected from the power source, no voltage will accumulate on the capacitor 52, and, thus, the alarm will not be activated at all.

By the above system, a person may conveniently use a hand-held appliance and receive an audible warning of an electrical hazard if the appliance is left in an idle state, but being electrically engaged for a fixed time period. The timing circuit provides more than a switch position indicator, as it prevents the annoyance of an alarm when the appliance is temporarily inactive.

From the above, it is apparent that other modifications and arrangements can be made to the above-described apparatus by those skilled in the art. The apparatus and circuit described herein are presented for illustrative purposes only and in no way are they intended to define the scope of the invention which can only be done through the appended claims.

What is claimed is:

1. An electrical hand-held hair-care appliance including a utilization circuit made operative by an electric power source, said appliance comprising:

switch means operative in at least two positions for routing the power from the power source, said switch means operative in a first position to deliver the power to said utilization circuit, and said switch means operative in a second position to deliver said power to an output of said switch means;

a timing circuit including circuit elements for generating a triggering signal after lapse of a predetermined time period after initial activation of said timing circuit by an input signal;

an alarm circuit including circuit elements responsive to said triggering signal for producing an alarm;

converting means receiving the power at the output of said switch means for converting said power to both said input signal and a circuit element powering signal; and means for delivering said circuit element powering signal to said circuit elements of said timing and alarm circuits, said circuit element powering signal powering said circuit elements of said timing and alarm circuits before said converting means produces said input signal.

2. The electrical appliance as recited in claim 1, wherein said timing circuit comprises a resistive-capacitive timing network.

3. The electrical appliance as recited in claim 2, wherein said electric power source is an alternating current power source and said timing circuit further includes a rectified current limiting circuit connected in series with the alternating current source to supply said resistive-capacitive timing network.

4. The electrical appliance as recited in claim 3, further comprising a filtering circuit for smoothing the rectified current limited alternating current power supplied to said resistive-capacitive timing network.

5. The electrical appliance as recited in claim 4, further including voltage protection means for limiting the maximum voltage supplied to said resistive-capacitive timing network.

6. The electrical appliance as recited in claim 5, wherein said alarm circuit comprises oscillating means and a piezoelectric crystal energized by said oscillating means.

7. The electrical appliance as recited in claim 1, wherein said alarm circuit comprises oscillating means and a piezoelectric crystal energized by said oscillating means.

8. For use with an electrical hand-held hair-care appliance including a utilization circuit made operative by an electric power source, an automatic warning circuit to warn a user of an electric hazard, said warning circuit comprising:

switch means operative in at least two positions for routing the power from the power source, said switch means operative in a first position to deliver the power to said utilization circuit, and said switch means operative in a second position to deliver said power to an output of said switch means;

a timing circuit including circuit elements for generating a triggering signal after lapse of a predetermined time period after initial activation of said timing circuit by an input signal;

an alarm circuit including circuit elements responsive to said triggering signal for producing an alarm;

converting means receiving the power at the output of said switch means for converting said power to both said input signal and a circuit element powering signal; and means for delivering said circuit element powering signal to said circuit elements of said timing and alarm circuits, said circuit element powering signal powering said circuit elements of said timing and alarm circuits before said converting means produces said input signal.

9. The warning circuit as recited in claim 8, wherein said timing means comprises a resistive-capacitive timing network.

10. The warning circuit as recited in claim 9, wherein said electric power source is an alternating current power source and said timing means further includes a rectified current limiting circuit connected in series with the alternating current source to supply said resistive-capacitive timing network.

11. The warning circuit as recited in claim 10, further comprising a filtering circuit for smoothing the rectified current limited alternating current power supplied to said resistive-capacitive timing network.

12. The warning circuit as recited in claim 11, further including voltage protection means for limiting the maximum voltage supplied to said resistive-capacitive timing network.

* * * * *